US011428064B2

(12) United States Patent
Kobayashi

(10) Patent No.: US 11,428,064 B2
(45) Date of Patent: Aug. 30, 2022

(54) DOWNHOLE TOOL AND WELL-DRILLING METHOD

(71) Applicant: Kureha Corporation, Tokyo (JP)

(72) Inventor: Fuminori Kobayashi, Tokyo (JP)

(73) Assignee: KUREHA CORPORATION, Tokyo (JP)

( * ) Notice: Subject to any disclaimer, the term of this patent is extended or adjusted under 35 U.S.C. 154(b) by 0 days.

(21) Appl. No.: 17/258,037

(22) PCT Filed: Jul. 10, 2019

(86) PCT No.: PCT/JP2019/027257
§ 371 (c)(1),
(2) Date: Jan. 5, 2021

(87) PCT Pub. No.: WO2020/013216
PCT Pub. Date: Jan. 16, 2020

(65) Prior Publication Data

US 2021/0246756 A1 Aug. 12, 2021

(30) Foreign Application Priority Data

Jul. 10, 2018 (JP) ..... JP2018-131093

(51) Int. Cl.
*E21B 33/12* (2006.01)

(52) U.S. Cl.
CPC ..... *E21B 33/12* (2013.01); *E21B 2200/08* (2020.05)

(58) Field of Classification Search
CPC ..... E21B 33/12; E21B 2200/08
See application file for complete search history.

(56) References Cited

U.S. PATENT DOCUMENTS

2015/0096741 A1 4/2015 Okura et al.
2016/0108165 A1* 4/2016 Takahashi ..... E21B 43/16 166/376
2016/0290083 A1 10/2016 Takahashi et al.
(Continued)

FOREIGN PATENT DOCUMENTS

CA 2868975 A1 12/2013
CA 2931282 A1 7/2015
(Continued)

OTHER PUBLICATIONS

Canadian Office Action for Application No. 3,104,631, dated Mar. 1, 2021.
(Continued)

*Primary Examiner* — Steven A MacDonald
(74) *Attorney, Agent, or Firm* — Birch, Stewart, Kolasch & Birch, LLP

(57) ABSTRACT

To provide a downhole tool that can maintain a high degradation rate even in high-temperature environments and a method for well drilling using the downhole tool. A downhole tool including: a component containing a reactive metal; and a component containing a degradable resin composition promoting degradation of the reactive metal, the degradable resin composition containing a degradable resin producing an acid by degradation, wherein a molar ratio of a maximum amount of the acid which the degradable resin composition is capable of producing to a content of the reactive metal is 1.0 or higher.

10 Claims, 1 Drawing Sheet

(56) References Cited

U.S. PATENT DOCUMENTS

| | | | | |
|---|---|---|---|---|
| 2016/0290091 | A1* | 10/2016 | Takahashi | F16J 15/102 |
| 2016/0305209 | A1* | 10/2016 | Fripp | E21B 33/1208 |
| 2017/0016298 | A1* | 1/2017 | Takahashi | E21B 29/02 |
| 2017/0175481 | A1 | 6/2017 | Kobayashi et al. | |
| 2017/0210873 | A1 | 7/2017 | Katayama et al. | |
| 2017/0218713 | A1* | 8/2017 | Walton | E21B 33/129 |
| 2017/0284167 | A1* | 10/2017 | Takahashi | C09K 8/725 |
| 2018/0187060 | A1* | 7/2018 | Okura | C08K 3/01 |
| 2019/0002667 | A1* | 1/2019 | Kobayashi | E21B 33/1208 |
| 2019/0017346 | A1 | 1/2019 | Kobayashi et al. | |
| 2019/0300676 | A1* | 10/2019 | Kobayashi | E21B 33/1208 |

FOREIGN PATENT DOCUMENTS

| | | | |
|---|---|---|---|
| CA | 2961930 | A1 | 3/2016 |
| CA | 2961932 | A1 | 3/2016 |
| CN | 104204404 | A | 12/2014 |
| CN | 105593463 | A | 5/2016 |
| CN | 105934481 | A | 9/2016 |
| CN | 106574072 | A | 4/2017 |
| CN | 106715826 | A | 5/2017 |
| EP | 2860344 | A1 | 4/2015 |
| EP | 3088657 | A1 | 11/2016 |
| EP | 3199748 | A1 | 8/2017 |
| JP | 2016-60900 | A | 4/2016 |
| JP | 2016-61127 | A | 4/2016 |
| WO | 2013/183363 | A1 | 12/2013 |
| WO | 2015/098801 | A1 | 7/2015 |
| WO | 2016/047501 | A1 | 3/2016 |
| WO | 2016/047502 | A1 | 3/2016 |
| WO | WO 2017/111159 | A1 | 6/2017 |

OTHER PUBLICATIONS

Chinese Office Action and Search Report for Chinese Application No. 201980039831.0, dated May 31, 2021, with English translation.

Chinese Office Action and Search Report (including an English translation thereof) issued in the corresponding Chinese Patent Application No. 201980039831.0 dated Nov. 17, 2021.

Canadian Office Action dated Dec. 3, 2021 for Application No. 3,104,631.

Great Britain Office Action dated Nov. 19. 2021 for Application No. GB2101439.4.

Chinese Office Action for Chinese Application No. 201980039831.0 dated Mar. 16, 2022, with English translation.

Chinese Office Action (including an English translation thereof) issued in the corresponding Chinese Patent Application No. 201980039931.0 dated May 30, 2022.

* cited by examiner

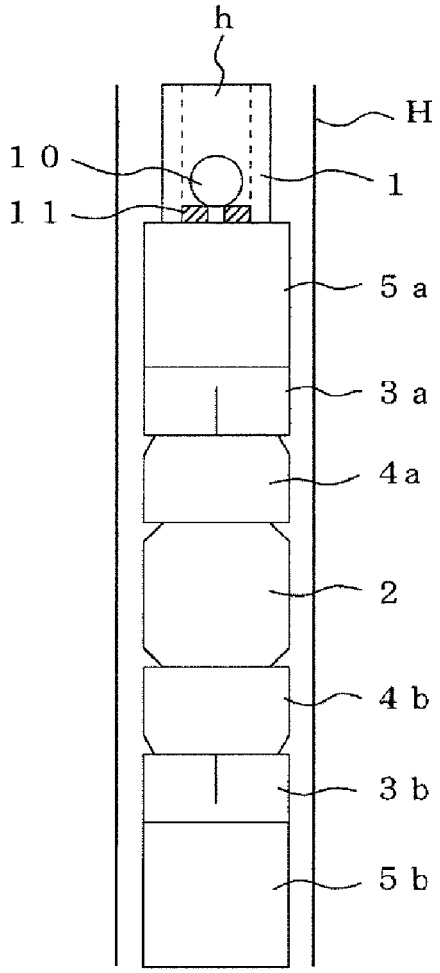
h
H
10
1
11
5a
3a
4a
2
4b
3b
5b

DOWNHOLE TOOL AND WELL-DRILLING METHOD

TECHNICAL FIELD

The present invention relates to a downhole tool and use of the downhole tool.

BACKGROUND ART

Downhole tools used for well drilling are subjected to extremely high forces (such as a tensile force, a compressive force, or a shear force) during a well treatment operation, such as, for example, fracturing. Thus, downhole tools require strength to withstand such forces. On the other hand, downhole tools need to be quickly removed in some way after well treatment.

To address this requirement, Patent Document 1 discloses a downhole tool containing a reactive metal and a degradable resin composition promoting degradation of the reactive metal.

CITATION LIST

Patent Document

Patent Document 1: JP 2016-61127 A

SUMMARY OF INVENTION

Technical Problem

However, the above technique has a problem in that the degradation rate of the downhole tool decreases in high-temperature environments of 100° C. or higher in the well.

The present invention has been made in light of the problem described above, and an object of the present invention is to provide a downhole tool that can maintain a high degradation rate even in high-temperature environments and a method for well drilling using the downhole tool.

Solution to Problem

As a result of diligent research to solve the above problems, the inventors have surprisingly found that setting a ratio of a reactive metal and a degradable resin to a specific value enables not only a degradation rate of a downhole tool to be maintained but also an initial degradation rate to be increased, and completed the present invention.

That is, a downhole tool according to the present invention includes: a component containing a reactive metal; and a component containing a degradable resin composition promoting degradation of the reactive metal, the degradable resin composition containing a degradable resin producing an acid by degradation, in which a molar ratio of a maximum amount of the acid which the degradable resin composition is capable of producing to a content of the reactive metal is 1.0 or higher.

In addition, a method for well drilling according to the present invention is a method for well drilling using a downhole tool, in which the downhole tool described above is used as the downhole tool.

Advantageous Effects of Invention

The present invention can provide a downhole tool that can maintain a high degradation rate even in high-temperature environments and a method for well drilling using the downhole tool.

BRIEF DESCRIPTION OF DRAWINGS

FIG. 1 is a schematic cross-sectional view illustrating an example of a downhole tool according to an embodiment of the present invention.

DESCRIPTION OF EMBODIMENTS

1. Downhole Tool

An embodiment of the present invention provides a downhole tool including: a component containing a reactive metal; and a component containing a degradable resin composition promoting degradation of the reactive metal, the degradable resin composition containing a degradable resin producing an acid by degradation, in which a molar ratio of a maximum amount of the acid which the degradable resin composition is capable of producing to a content of the reactive metal is 1.0 or higher. At the stage of starting production of petroleum, gas, or the like, typically, the downhole tool is preferably removed quickly in some way as described above.

As a specific example of the downhole tool, a plug illustrated in a schematic cross-sectional view of FIG. 1 will be described. Plugs include frac plugs or bridge plugs. A typical structure of the plug includes a mandrel 1 extending in the extending direction of the downhole and a plurality of annular components disposed on the outer circumferential surface of the mandrel 1 along the axial direction of the mandrel 1.

The mandrel 1 is often a hollow tubular body but is not limited. In addition, the mandrel 1 is typically approximately from 30 to 200 mm in outer diameter and approximately from 250 to 2000 mm in length. The components placed on the outer circumferential surface of the mandrel 1 include an annular rubber component 2, slips 3*a* and 3*b*, wedges 4*a* and 4*b*, and a pair of rings 5*a* and 5*b*.

The plug illustrated in the schematic cross-sectional view of FIG. 1 further includes a ball sealer (ball) 10 and a substantially round annular ball seat 11 having a circular cavity with a smaller diameter than that of the ball sealer 10, in a hollow part h of the mandrel 1.

The case of performing fracturing (which is one of well treatment operations) using the plug described above will be described below. Note that the structure of the plug serving as a downhole tool is not limited to the structure described above.

The pair of rings 5*a* and 5*b* is configured to be slidable along the axial direction of the mandrel 1 on the outer circumferential surface of the mandrel 1 and a distance between the rings 5*a* and 5*b* is adjustable. Furthermore, the pair of rings 5*a* and 5*b* are configured to be directly or indirectly in contact with the annular rubber component 2 and the end portions along the axial direction of the combination of the slips 3*a* and 3*b* and the wedges 4*a* and 4*b*. This enables the pair of rings 5*a* and 5*b* to exert a force to the annular rubber component 2 and the combination of the slips 3*a* and 3*b* and the wedges 4*a* and 4*b* along the axial direction of the mandrel 1.

The annular rubber component 2, as is compressed in the axial direction of the mandrel 1, expands in diameter in the direction orthogonal to the axial direction of the mandrel 1, the outer side of the annular rubber component 2 comes into contact with an inner wall H of the downhole, and the inner side of the annular rubber component 2 comes into contact with the outer circumferential surface of the mandrel 1. As a result, the annular rubber component 2 plugs (seals) the space between the plug and the downhole.

Then, while fracturing is performed, the annular rubber component 2 maintains a state of contact with the inner wall H of the downhole and the outer circumferential surface of the mandrel 1, thereby having a function of maintaining the seal between the plug and the downhole.

In addition, the force exerted in the axial direction of the mandrel 1 causes the slips 3*a* and 3*b* to slide on the slopes of the wedges 4*a* and 4*b*. This causes the slips 3*a* and 3*b* to move outward orthogonal to the axial direction of the mandrel 1 and come into contact with the inner wall H of the downhole. Thus, the plug and the inner wall H of the downhole can be fixed.

In addition, although not illustrated, these components included in the downhole tool may include a ratchet mechanism which is configured to engage the outer circumferential surface of the mandrel 1 and the inner peripheral surface of the component. The ratchet mechanism is formed of a plurality of engaging portions allowing movement of the component in one direction along the axial direction of the mandrel 1 and limiting movement of the component in the opposite direction.

In addition, both the ball sealer 10 and the ball seat 11 included in the hollow part h of the mandrel 1 can move along the axial direction of the mandrel 1 inside the hollow part h of the mandrel 1. The ball sealer 10 comes into contact with or moves away from the circular cavity of the ball seat 11, thereby adjusting the flow of a fluid.

A downhole tool according to the present embodiment includes: a component containing a reactive metal; and a component containing a degradable resin composition promoting degradation of the reactive metal, the degradable resin composition containing a degradable resin producing an acid by degradation, in which a molar ratio of a maximum amount of the acid which the degradable resin is capable of producing to a content of the reactive metal is 1.0 or higher. This enables the well treatment to be reliably performed under various well environments, and increasingly severe and various excavation conditions. In addition, the downhole tool according to the present embodiment is easily removed and can contribute to reducing the expense and shortening the process of well drilling. That is, the present invention provides a downhole tool having degradability in a predetermined environment and excellent strength.

The downhole tool according to the present embodiment preferably includes a slip, and the slip is preferably a component containing a reactive metal described below.

2. Component Containing Reactive Metal

The downhole tool according to the present embodiment includes a component containing a reactive metal. In general, among components included in downhole tools, for example, a mandrel and a slip are subjected to extremely high forces (such as a tensile force, a compressive force, or a shear force) when a downhole tool is disposed in a well or a well treatment operation, such as, for example, fracturing is carried out. Thus, downhole tools require strength to withstand such forces, and metal is often used as a material.

The downhole tool according to the present embodiment contains a reactive metal, and this enables the downhole tool to maintain strength. Thus, the component containing a reactive metal is preferably a component containing a reactive metal as a main component and is more preferably a component consisting essentially of a reactive metal.

Reactive Metal

The reactive metal in the present embodiment is a single substance of a base metal element or an alloy containing the base metal element as a main component. As used herein, "containing as a main component" typically refers to a content of 50 mass % or greater, preferably 60 mass % or greater, and more preferably 70 mass % or greater.

The base metal is a metal having a large ionization tendency, not chemically stable, and having properties of being easily oxidized and not releasing oxygen even when the oxide is heated. Examples of the base metal include alkali metals belonging to Group I or alkaline earth metals belonging to Group II of the periodic table, aluminum, and iron, but among them, the base metal is preferably at least one selected from the group consisting of magnesium, aluminum, and calcium, more preferably magnesium or aluminum, and even more preferably magnesium.

The reactive metal in the present embodiment is preferably an alloy from the perspectives of ease of controlling the degradation in a well environment, or strength and ease of handling required for the downhole tool components. The composition of the alloy contains the base metal as described above as a main component and preferably contains at least one selected from the group consisting of lithium, gallium, indium, zinc, bismuth, tin, copper, and the like as a minor component.

The content of the minor component in total is preferably 50 mass % or less, more preferably 40 mass % or less, and even more preferably 30 mass % or less.

A person skilled in the art can appropriately select the reactive metal to be used and the composition containing the reactive metal according to predetermined conditions, such as an expected well environment.

In general, when a metal component included in the downhole tool is to be removed at the stage of starting production of petroleum, gas, or the like, the metal component is destroyed or fragmented typically by milling, drilling out, or other methods. On the other hand, the component containing the reactive metal included in the downhole tool according to the present embodiment can be removed, for example, by bringing the component into contact with an aqueous fluid, such as an acidic fluid, in a predetermined well environment in a short period of time from hours to 30 days, not by milling, drilling out, or the like.

Furthermore, the downhole tool according to the present embodiment promotes a degradation reaction of the reactive metal, in particular, without necessarily using an acidic fluid as an aqueous fluid, specifically without injecting an acidic fluid into a wellbore.

In the downhole tool of the present embodiment, examples of the component preferably containing a reactive metal as a main component include a ball sealer and a ball seat, in addition to a slip. In the slip, at least a portion facing the inner wall of the wellbore may only need contain a reactive metal as a main component.

Method of Producing Component Containing Reactive Metal

The component containing the reactive metal included in the downhole tool according to the present embodiment can be produced by a method, known per se, of producing a metal component used in a downhole tool using the reactive metal described above and various blended materials contained as desired as raw materials.

Specifically, a desired component can be obtained by producing a molded product in a shape corresponding to a shape of each component, such as a bar shape (such as a round bar shape, a square bar shape, or a heteromorphic cross sectional shape), a tubular shape, a plate shape (sheet form), a spherical shape, a cylindrical shape, a prism shape, a pellet form, or a granular form, by a molding method, such as powder metallurgy, compression molding, extrusion, or die casting, and further cutting, shearing, perforating, or other machining as necessary. In addition, rolling treatment, homogenization treatment, and the like may be performed on the molded product to increase the strength.

3. Component Containing Degradable Resin Composition Promoting Degradation of Reactive Metal The downhole tool according to the present embodiment includes a component containing a degradable resin composition promoting degradation of a reactive metal (which may be hereinafter referred to simply as a "component containing a degradable resin composition") as the component included in the downhole tool together with the component containing a reactive metal. The component containing the degradable resin composition included in the downhole tool according to the present embodiment is not particularly limited, but examples include components other than a slip, and a ball sealer.

Degradable Resin Composition Promoting Degradation of Reactive Metal

The degradable resin composition promoting degradation of the reactive metal in the present embodiment contains a resin (which may be hereinafter referred to as a "polymer") producing an acid by degradation of the resin composition, that is, losing the initial composition or the like.

The degradable resin composition in the present embodiment can promote degradation of the reactive metal described above (hereinafter described simply as a "reactive metal") by producing an acid by degradation. In more detail, an acid produced mainly by degradation of the resin contained in the resin composition comes into contact with the reactive metal, and this promotes the degradation reaction of the reactive metal.

In addition to this, the degradation reaction of the reactive metal may include another reaction mechanism. Specific examples of another reaction mechanism expected include a case where the resin composition contains a blended agent, and the degradable resin contained in the resin composition is eliminated in a predetermined environment, and a portion or all of the remaining blended agent comes into contact with the reactive metal, thereby promoting degradation of the reactive metal.

Degradable Resin Producing Acid by Degradation

The degradable resin composition in the present embodiment contains a degradable resin producing an acid by degradation. In the degradable resin, one or some or all of the bonds of the main chain or the like of the resin (polymer) are broken in a predetermined environment, producing a free acid (including an acid derivative having reactivity). The acid produced promotes degradation of the reactive metal.

The acid produced from the resin contained in the component containing the degradable resin composition can come into contact with the reactive metal at a close proximity and at a high acid concentration. Thus, the acid produced from the degradable resin promotes degradation of the reactive metal.

In addition, in general, when the reactive metal and the aqueous fluid come into contact with each other and the reactive metal degrades, the aqueous fluid often becomes strongly alkaline. However, according to the downhole tool according to the present embodiment, the acid produced neutralizes the alkali, and thus this can prevent the well environment near the circumference of the downhole tool, more specifically near the circumference of the component containing the reactive metal, from becoming alkaline. As a result of this, the effect of further promoting degradation of the reactive metal can be also expected.

The degradable resin producing an acid by degradation is not particularly limited, but examples include polyesters, and among them, hydrolyzable degradable resins are preferred. From the perspectives of degradability, ease of controlling degradation in a well environment, or processability of the resin (polymer), examples preferably include aliphatic polyesters. Thus, the degradable resin composition in the present embodiment preferably contains an aliphatic polyester.

The aliphatic polyester preferably contained in the degradable resin composition is also widely known as a degradable resin, and examples include polyglycolic acid (PGA), polylactic acid (PLA), and poly-ε-caprolactone.

From the perspectives described above, the aliphatic polyester is preferably at least one selected from the group consisting of PGA, PLA, and a glycolic acid-lactic acid copolymer (PGLA), and a more preferred aliphatic polyester is PGA.

The PGA as a more preferred aliphatic polyester includes, in addition to homopolymers of glycolic acid, copolymers containing 50 mass % or greater, preferably 75 mass % or greater, more preferably 85 mass % or greater, even more preferably 90 mass % or greater, particularly preferably 95 mass % or greater, most preferably 99 mass % or greater, and especially preferably 99.5 mass % or greater of glycolic acid repeating units. Use of PGA having many glycolic acid repeating units can provide a downhole tool component having excellent strength.

The PLA includes, in addition to homopolymers of L-lactic acid or D-lactic acid, copolymers containing 50 mass % or greater, preferably 75 mass % or greater, more preferably 85 mass % or greater, and even more preferably 90 mass % or greater of repeating units of L-lactic acid or D-lactic acid, and stereocomplex polylactic acids obtained by mixing a poly-L-lactic acid and a poly-D-lactic acid.

As the PGLA, a copolymer with a ratio (mass ratio) of glycolic acid repeating units to lactic acid repeating units of 99:1 to 1:99, preferably 90:10 to 10:90, and more preferably 80:20 to 20:80 can be used.

The melt viscosity (measurement conditions: temperature 270° C., shear rate 122 $sec^{-1}$) of these aliphatic polyesters is not particularly limited, but from the perspectives of degradability, strength, or moldability of the downhole tool, the melt viscosity is typically from 100 to 10000 Pa·s, often from 200 to 5000 Pa·s, and almost always from 300 to 3000 Pa·s.

The aliphatic polyester preferably contained in the component containing the degradable resin composition degrades to produce an acid that is an acidic material. Examples of the acid produced include glycolic acid, lactic acid, or their oligomers (those belonging to acids).

Thus, the acid produced, such as glycolic acid or lactic acid, comes into contact with the reactive metal at a close proximity and at a high concentration, thereby promoting degradation of the reactive metal.

For the effect of promoting degradation of the reactive metal, for example, a magnesium alloy (trade name: INTallic (trademark)), when immersed in deionized water, is not reactive but, when immersed in a 4 mass % glycolic acid aqueous solution, immediately produces bubbles ($H_2$ gas), dissolves, and produces a precipitate. At the same time, the glycolic acid aqueous solution, initially acidic, changes to alkaline. It can be thus confirmed that the magnesium alloy has been degraded.

The content of the degradable resin in the degradable resin composition in the present embodiment, the degradable resin producing an acid by degradation, is not particularly limited but is typically 30 mass % or greater, preferably 50 mass % or greater, and more preferably 70 mass % or greater. The upper limit of the content of the degradable resin producing an acid by degradation described above is not particularly limited and may be 100 mass % (i.e., the entire amount of the composition described above) but often is 99 mass % or less and almost always 95 mass % or less.

Inorganic Substance or Organic Substance Promoting Degradation of Reactive Metal The degradable resin composition in the present embodiment can contain an inorganic substance or an organic substance (which may be hereinafter referred to as a "degradation trigger") promoting degradation of the reactive metal, in addition to the degradable resin producing an acid by degradation.

The inorganic substance is not limited and can be any inorganic substance that can promote degradation of the reactive metal, and examples include inorganic acids, such as hydrochloric acid, nitric acid, phosphoric acid, sulfuric acid, boric acid, and hydrofluoric acid; acid precursors, such as anhydrates and esters of inorganic acids; and inorganic salts, such as sodium chloride and potassium chloride.

Examples of the organic substance include organic acids, such as citric acid, succinic acid, oxalic acid, glycolic acid, lactic acid, formic acid, and acetic acid; acid precursors, such as anhydrates and esters of organic acids; and organic salts.

For the degradation trigger, an optimal substance can be selected from the perspectives of form of the substance (such as solid, liquid, or gas) in a well environment (e.g., temperature), the promoting effect of the substance on the degradation reaction of the reactive metal, or solubility in an aqueous fluid. The degradation trigger is preferably an inorganic salt from the perspectives of solubility; and more preferably an inorganic salt containing either potassium chloride or sodium chloride from the perspectives of the promoting effect on the degradation reaction of the reactive metal and ease of handling. In addition, from the perspective of the promoting effect on the degradation reaction of the reactive metal, the degradation trigger is preferably an inorganic acid or an organic acid, or an acid precursor of the inorganic acid or organic acid, and particularly preferably an acid precursor.

For the effect of promoting degradation of the reactive metal, for example, the magnesium alloy described above (trade name: IN-Tallic (trademark)), when immersed in deionized water, is not reactive but, when immersed in a 4 mass % sodium chloride aqueous solution, immediately produces bubbles ($H_2$ gas), dissolves, and produces a precipitate. At the same time, the sodium chloride aqueous solution, initially neutral, changes to alkaline, and this can confirm that the magnesium alloy has been degraded.

In a case where the degradable resin composition in the present embodiment contains the degradable resin and the degradation trigger, the mass ratio of the degradable resin to the degradation trigger is to be set to an optimal range according to the type of reactive metal, the combination of the degradable resin and the degradation trigger, or a well environment. The mass ratio of the degradable resin to the degradation trigger is typically from 90:10 to 10:90, often from 85:15 to 50:50, and almost always from 80:20 to 60:40. In one example, such as when the degradable resin producing an acid by degradation accounts for a large proportion in the degradable resin, the mass ratio is from 99:1 to 90:10.

Additional Degradable Resin

The degradable resin composition in the present embodiment can contain an additional degradable resin in addition to the degradable resin producing an acid by degradation. In addition, the additional degradable resin may contain the degradation trigger described above. In a case where the additional degradable resin contains the degradation trigger, the additional degradable resin contained in the degradable resin composition degrades and is eliminated in a predetermined environment (specifically, such as a well environment in which an aqueous fluid is supplied), and the degradation trigger contained in the additional degradable resin is released. Then, the degradation trigger can come into contact with the reactive metal at a close proximity and at a high inorganic substance or organic substance concentration and thus can promote degradation of the reactive metal.

Examples of the degradable resin degrading and eliminated in a predetermined environment preferably include a water-soluble resin, which may dissolve in a solvent, such as water, present in the predetermined environment or may absorb water, and then may lose its shape. In addition, examples of the degradable resin preferably include a degradable rubber that can degrade, for example, by coming into contact with water in the predetermined environment.

Water-Soluble Resin

Examples of the water-soluble resin preferably used include polyvinyl alcohol (PVA), polyvinyl butyral, polyvinyl formal, polyacrylamide (which may be N,N-substituted), polyacrylic acid, and polymethacrylic acid. In addition, examples of the water-soluble resin include copolymers of monomers forming these resins, such as, for example, an ethylene-vinyl alcohol copolymer (EVOH) and an acrylamide-acrylic acid-methacrylic acid interpolymer.

From the perspectives of ease of controlling degradability, strength, or ease of handling, the water-soluble resin preferably contains PVA, EVOH, polyacrylic acid, polyacrylamide, or the like, and more preferably contains a polyvinyl alcohol-based polymer (PVA-based polymer), such as PVA or EVOH.

The PVA-based polymer is a polymer containing a vinyl alcohol unit, specifically a polymer obtained by saponifying a polymer containing a vinyl acetate unit. That is, a polymer (PVA) or copolymer (such as EVOH) containing a vinyl alcohol unit is obtained by polymerizing vinyl acetate, together with another monomer that is copolymerizable with vinyl acetate (e.g., an olefin, such as ethylene) as necessary, in an alcohol solvent, such as methanol, and then substituting the acetate group of the vinyl acetate unit in the polymer with a hydroxyl group using an alkali catalyst in an alcohol solvent.

Degradable Rubber

As the degradable rubber preferably used, those containing a degradable rubber that has been used to form a degradable sealing component for a downhole tool in the art can be used. The degradability of the degradable rubber refers to degradability of chemical nature of some form, including biodegradability, hydrolyzability, or the like. In addition, the disintegrability also refers to ease of disintegration of the component containing the degradable rubber and losing its shape upon application of a very small mechanical force (disintegrability), as a result of decrease in intrinsic strength and embrittlement of the rubber due to decrease in the degree of polymerization, for example.

Furthermore, when the degradable rubber is used in combination with the degradable resin producing an acid by degradation described above, the degradation of the degradable rubber is further promoted by an acid produced from the degradable resin producing an acid by degradation. One type of degradable rubber may be used alone, but two or more types of degradable rubbers may be mixed and used.

Examples of the degradable rubber include degradable rubbers containing at least one selected from the group consisting of urethane rubber, natural rubber, isoprene rubber, ethylene propylene rubber, butyl rubber, styrene rubber, acrylic rubber, aliphatic polyester rubber, chloroprene rubber, polyester-based thermoplastic elastomer, and polyamide-based thermoplastic elastomer.

In addition, from the perspective of degradability and disintegrability, examples of the degradable rubber preferably include degradable rubbers containing a rubber having a hydrolyzable functional group (e.g., a urethane group, an ester group, an amide group, a carboxyl group, a hydroxyl group, a silyl group, an acid anhydride, or an acid halide). As used herein, "having a functional group" means having a functional group as a bond forming a main chain of the rubber molecule or having a functional group as a side chain of the rubber molecule, for example, serving as a crosslinking point.

Particularly preferred examples of the degradable rubber include a urethane rubber because its degradability and disintegrability can be easily controlled by adjusting the structure, hardness, degree of crosslinking, or the like of the rubber, or by selecting an additional blended agent. That is, particularly preferred degradable rubbers are those containing a urethane rubber having a hydrolyzable urethane bond. In addition, similarly, degradable rubbers containing a polyester-based thermoplastic elastomer or a polyamide-based thermoplastic elastomer are also preferred.

The urethane rubber (which may also be referred to as a "urethane elastomer") particularly preferably used as the degradable rubber is a rubber material having a urethane bond (—NH—CO—O—) in the molecule and is typically obtained by condensation of an isocyanate compound and a compound having a hydroxyl group.

As the isocyanate compound, an aromatic (which may have a plurality of aromatic rings), aliphatic, or alicyclic di-, tri-, or tetra-polyisocyanate, or a mixture of these polyisocyanates are used.

Compounds having a hydroxyl group are broadly classified into ester-based polyols having ester bonds in the main chain and ether-based polyols having ether bonds in the main chain. A urethane rubber obtained by using an ester-based polyol as the compound having a hydroxyl group is referred to as a polyester urethane rubber (which may be hereinafter referred to as an "ester urethane rubber"), and a urethane rubber obtained by using an ether-based polyol as the compound having a hydroxyl group is referred to as a polyether urethane rubber (which may be hereinafter referred to as an "ether urethane rubber"). An ester-based urethane rubber is often preferred because its degradability or disintegrability is easier to control.

Urethane rubber is an elastic body having both the elasticity (flexibility) of synthetic rubber and the rigidity (hardness) of plastic and is generally known to be excellent in abrasion resistance, chemical resistance, and oil resistance, and have high mechanical strength, high load tolerance, high elasticity, and high energy absorbency.

Urethane rubbers are classified according to the difference in the molding method into (i) a kneading (millable) type, which can be molded by the same processing method as that for general rubber; (ii) a thermoplastic type, which can be molded by the same processing method as that for a thermoplastic resin; and (iii) a casting type, which can be molded by a processing method of thermosetting using liquid starting materials. Any type can be used as the urethane rubber contained in the degradable resin composition in the present embodiment.

Other Additives

In addition to the degradable resin and the degradation trigger described above, the degradable resin composition in the present embodiment can contain an additive as desired within a range that does not interfere with the object of the present invention. Examples of such an additive may include typically used additives, such as fillers, plasticizers, colorants, UV absorbers, antioxidants, processing stabilizers, weather-resistant stabilizers, antistatic agents, flame retardants, release agents, fungicides, and preservatives.

For the content of these additives, an optimal range is to be selected according to their types and a well environment, but in the degradable resin composition described above, the content is typically from 0 to 80 mass %, often from 0 to 70 mass %, and according to the type of additional additive, from 0 to 10 mass % (0 mass % means containing no additive).

For example, the degradable resin composition described above may contain a filler from the perspective of providing a downhole tool component having excellent strength. Examples of the filler include inorganic fillers, such as talc, clay, calcium carbonate, silica, mica, alumina, titanium oxide, zirconium oxide, boron nitride, aluminum nitride, and glass; and organic fillers, such as a urea-formalin-based resin and a melamine-formalin-based resin.

The filler may contain at least one of inorganic fillers or organic fillers. In addition, for the form of the filler, a fibrous filler or a particulate filler may be used. That is, the filler may contain at least one of a fibrous filler or a particulate filler.

The content of the filler is not particularly limited, but in the degradable resin composition described above, the content is typically from 0 to 70 mass % and preferably from 0 to 50 mass % (0 mass % means containing no filler).

Additional Polymer

The degradable resin composition in the present embodiment may further contain an additional polymer from the perspective of improving various properties as described above. As the additional polymer described above, for example, a commodity resin, such as polyethylene, polypropylene, an ABS resin, or polystyrene, can be also used.

However, from the perspective of making the component included in the downhole tool not easily damaged even in contact or collision with various components used in well drilling under increasingly severe and diversified excavation conditions, such as, for example, increased depth, the component preferably further contains a polymer that can act as a shock absorber.

Specifically, examples may include various rubber materials or elastomer materials. More specifically, examples include natural rubbers or synthetic rubbers, such as natural rubber, isoprene rubber, ethylene propylene rubber, and polyurethane rubber; and thermoplastic elastomers, such as thermoplastic olefin-based elastomers (such as ethylene-propylene copolymers and ethylene-vinyl acetate copolymers), thermoplastic polyester elastomers (such as aromatic polyester-aliphatic polyester block copolymers and polyester-polyether block copolymers), thermoplastic polyurethane elastomers, styrene-based thermoplastic elastomers, such as styrene-butadiene-styrene block copolymers and styrene-ethylene/butylene-styrene block copolymers (SEBS), and acrylic rubber-containing methacrylate resins containing an acrylic rubber of a rubber component phase in a hard component phase of a methacrylate-based resin, preferably having a core-shell structure.

The content of the additional polymer is not particularly limited, but in the degradable resin composition described above, the content is typically from 0 to 30 mass % and preferably from 0 to 15 mass % (0 mass % means containing no additional polymer).

Method of Producing Component Containing Degradable Resin Composition

The component containing the degradable resin composition in the present embodiment can be produced by a molding method known per se matching with the shape or size of the downhole tool component containing the resin, using various blended materials serving as various components for forming the degradable resin composition described above as raw materials.

Typically, a component containing the degradable resin composition produced by melt molding is provided. As the melt molding method, a general-purpose melt molding method can be employed, such as injection molding, compression molding, centrifugal molding, or extrusion molding (extrusion molding, inflation molding, or the like using a T die, rod die, or annular die can be employed, and solidification- and extrusion-molding can be also used). Additionally, the component can be produced using a resin molding method known per se, such as a solution casting method, centrifugal molding, or sintering molding, according to the shape or size of the downhole tool component.

When the component containing the degradable resin composition is formed by a combination of a plurality of part components, the component containing the degradable resin composition can be produced by what is called insert molding or outsert molding. Furthermore, a downhole tool component having a desired shape (such as a ball shape, a bar shape having a heteromorphic cross section, a hollow shape, or a plate shaped body) can be produced by subjecting a molded product obtained by these melt molding methods as a preform (which can be formed into a shape, such as a rod shape, a hollow shape, or a plate-shape) to cutting, shearing, perforation, or other machining.

4. Downhole Tool Containing Reactive Metal and Degradable Resin Composition Promoting Reactive Metal The downhole tool according to the present embodiment containing a reactive metal and a degradable resin composition contains a reactive metal and a degradable resin composition promoting degradation of the reactive metal in combination, in which a molar ratio of a maximum amount of an acid which the degradable resin composition is capable of producing to a content of the reactive metal is 1.0 or higher.

As used herein, the "content of the reactive metal" refers to the amount of a base metal contained in the reactive metal. In addition, the "maximum amount of an acid which the degradable resin composition is capable of producing" refers to an amount of an acid produced when a degradable resin contained in the degradable resin composition completely degrades in a case where the degradable resin composition contains no degradation trigger that is an acid. On the other hand, in a case where the degradable resin composition contains a degradation trigger that is an acid in addition to the degradable resin, the "maximum amount of an acid which the degradable resin composition is capable of producing" refers to a total amount of an amount of an acid produced when the degradable resin is completely degraded and an amount of an acid in the degradable trigger.

For example, in a case where the degradable resin composition contains no degradation trigger that is an acid, where the smallest molecule produced when the degradable resin is degraded corresponds to a structural unit of the degradable resin, and in a case where the molecule contains one acidic group, the maximum amount of an acid which the degradable resin composition is capable of producing is equal to the number of the structural unit of the degradable resin.

The molar ratio of the maximum amount of an acid which the degradable resin composition is capable of producing to the content of the reactive metal is 1.0 or higher, but preferably 1.5 or higher and more preferably 1.8 or higher although the preferred molar ratio varies with the type of reactive metal.

With the lower limit of the molar ratio satisfying the range described above, the downhole tool according to the present embodiment has a high initial degradation rate and can maintain the degradation rate even in high-temperature environments of 100° C. or higher, and can be eliminated in a short period of time from hours to 30 days.

For a typical downhole tool, the period of time until the elimination is preferably within 30 days, more preferably within 21 days, and even more preferably within 14 days.

In addition, as shown in the examples described later, when a study was conducted under relatively low temperature conditions (66° C.), no significant change was found in the degradation rate after a lapse of 10 hours even when the composition of the reactive metal and the degradable resin composition was changed. However, as a result of studying the composition of the component forming the downhole tool, the inventors of the present application have surprisingly found that the composition of the reactive metal and the degradable resin composition influences not only the initial degradation rate but also the maintenance of the degradation rate after a lapse of a predetermined period of time. It is presumed that the presence of the acid produced from the degradable resin composition prevents formation of a passivation film that is formed on the surface of the reactive metal at the same time as the degradation of the reactive metal, thus maintaining the degradation rate under high-temperature conditions. Thus, the component satisfying the conditions of the composition described above has a high initial degradation rate and can maintain the degradation rate under high-temperature conditions of 100° C. or higher, and is eliminated in a short period of time from hours to 30 days.

The downhole tool according to the present embodiment includes a component containing a reactive metal and a component containing a degradable resin composition but may be a downhole tool including a component containing both a reactive metal and a degradable resin composition promoting degradation of the reactive metal in one component.

The component containing a reactive metal and a degradable resin composition is desirable because the component contains a reactive metal and a degradable resin composition promoting degradation of the reactive metal in combination in the component, thus comes into contact with the reactive metal at a closer proximity and can promote degradation of the reactive metal.

In the downhole tool according to the present embodiment, one or some or all of downhole tool components containing a reactive metal or downhole tool components containing a degradable resin composition can be a downhole tool component(s) containing a reactive metal and a degradable resin composition.

Specific Examples of Downhole Tool

Preferred specific examples of the downhole tool according to the present embodiment include a downhole tool that is a plug or a downhole tool that is of a sleeve system including a ball sealer (ball) and a ball seat.

For example, a slip is formed of a material containing a reactive metal; a mandrel, a wedge, a ring, a ball seat, and a ball are formed from the degradable resin composition; further, for an annular rubber member, a degradable rubber component is used; and a frac plug (downhole tool) including these components can be formed.

More specifically, examples preferably include a downhole tool that is a plug (such as a frac plug) including a slip in which at least a portion in contact with an inner wall of a wellbore contains a reactive metal as a main component, and at least one downhole tool component other than the slip, the downhole tool component containing a degradable resin composition as a main component. Furthermore, examples preferably include a downhole tool that is a plug (such as a frac plug) including a degradable rubber component formed of a degradable rubber, and a ball sealer containing a reactive metal as a main component.

In addition, a ball seat is formed of a material containing a reactive metal; a ball sealer (ball) is formed from the degradable resin composition; and a sleeve system (downhole tool) including these components can be formed.

More specifically, examples preferably include a downhole tool that is a sleeve system in which a ball seat contains a reactive metal as a main component, and a ball sealer contains the degradable resin composition.

Method of Producing Downhole Tool

A method of producing a downhole tool including a component containing a reactive metal and a component containing the degradable resin composition according to the present embodiment is not particularly limited. A downhole tool can be produced by arranging downhole tool components, such as a mandrel, an annular rubber component, a slip, a wedge, a ring, a ball sealer, and a ball seat, according to a common method.

In addition, a downhole tool may be obtained by configuring a portion (such as a part) of the downhole tool, such as a ratchet mechanism, to contain a reactive metal or to contain the degradable resin composition promoting the reactive metal.

5. Method for Well Drilling

In the present embodiment, a method for well drilling is provided, the method using the downhole tool of the present invention described above. Specifically, provided is a method for well drilling including performing well treatment, such as fracturing, using the downhole tool described above. Furthermore, provided is a method for well drilling in which well treatment, such as fracturing, is performed using the downhole tool described above, and then the reactive metal is degraded and eliminated by the degradable resin composition described above.

In particular, provided are a method for well drilling in which well treatment, such as fracturing, is performed using the downhole tool described above, then a degradable resin contained in the degradable resin composition described above degrades to produce an acid or an inorganic substance or an organic substance promoting degradation of the reactive metal, and this degrades and eliminates the reactive metal; and a method for well drilling in which well treatment, such as fracturing, is performed using the downhole tool described above, then a degradable resin contained in the degradable resin composition described above degrades to produce an acid or an inorganic substance or an organic substance promoting degradation of the reactive metal, and this degrades and eliminates the reactive metal, and at the same time, a degradable rubber component disintegrates or is eliminated by degradation.

Also provided is a method for well drilling in which a ball sealer containing at least one of a reactive metal or the degradable resin composition is brought into contact with a ball seat containing at least the other of the reactive metal or the degradable resin composition (the other not the one described above) to perform well treatment.

The method for well drilling using the downhole tool according to the present embodiment eliminates the need for an operation, such as milling or drilling out, that has been performed in the art at great expense and time to remove a downhole tool or downhole tool component. Furthermore, the method can eliminate the need for a special additional operation, such as an injection of an acid into the well, that has been employed in the art to remove a downhole tool component containing a reactive metal or the like. Thus, the method can contribute to reducing the expense and shortening the process of well drilling.

For example, the method for well drilling provided as another present embodiment is a method of performing well treatment, such as perforation or fracturing, using a downhole tool that is a plug, such as a frac plug or a bridge plug, or a sleeve system including a ball sealer and a ball seat.

In addition, the method for well drilling according to the present embodiment is a method of performing well treatment, such as perforation or fracturing, in a downhole using a ball sealer and a ball seat.

Furthermore, the method for well drilling according to the present embodiment is a method for performing fracturing using a fracturing fluid containing a proppant.

As a specific example, a method for well drilling using a plug (downhole tool) including a slip containing a magnesium alloy (reactive metal) and a plug (downhole tool) including a mandrel made of PGA (a degradable resin).

To perform fracturing, first, an annular rubber component is expanded in diameter to maintain a state of contact with the inner wall of the downhole and the outer circumferential surface of the mandrel, thereby maintaining the seal between the plug and the downhole. Along with this, the outer end of the slip described above orthogonal to the axial direction of the mandrel is brought into strong contact with the inner wall of the downhole, thereby fixing the plug to resist high fracturing pressure.

Then, after the completion of fracturing, the mandrel made of PGA described above degrades in a desired short period of time, such as from several hours to 30 days, by bringing an aqueous fluid into contact as desired in various downhole temperature environments. The temperature is, for example, 93° C. or higher, 79° C. or higher, 71° C. or higher, 66° C. or higher, 60° C. or higher, and 40° C. or higher in order of preference. In addition, the temperature is preferably 150° C. or lower.

As a result of the degradation of the mandrel, glycolic acid is produced, the mandrel decreases in volume or loses strength, and the seal between the plug and the downhole is released. Furthermore, the mandrel loses its original shape, and the downhole tool (specifically the plug) including the mandrel as a downhole tool component loses its original shape.

In addition, glycolic acid produced by the degradation of PGA promotes degradation of the magnesium alloy, which is a reactive metal, and as a result, the slip, which is a downhole tool component, decreases in volume and loses its original shape.

This allows the slip to be easily removed or eliminated.

The method for well drilling according to the present embodiment eliminates the need for not only recovering or destroying the downhole tool or downhole tool component but also an additional operation, such as an injection of an acid into a wellbore and thus can contribute to reducing the expense and shortening the process of well drilling.

In addition, in the specific example described above, configuring the downhole tool to include the annular rubber component as a degradable rubber component allows the reactive metal contained in the slip, which is a downhole tool component containing the magnesium alloy, which is a reactive metal, to be degraded and eliminated. In parallel with this, the annular rubber component, which is a degradable rubber component, degrades and disintegrates or is eliminated in a desired short period of time, such as from several hours to 30 days, by bringing an aqueous fluid into contact as desired in the various downhole temperature environments described above. That is, this method for well drilling can further contribute to reducing the expense and shortening the process of well drilling.

Still more, another specific example may include a method for well drilling as described below. First, a ball sealer (ball) formed from a degradable resin composition is charged into a downhole tool (plug or sleeve system) including a ball seat formed from a material containing a reactive metal so that the ball sealer and the ball seat come into close proximity or contact. The ball is brought into contact with the ball seat to perform well treatment, such as fracturing. Together with this, after the well treatment is performed, the reactive metal is degraded and eliminated with the degradable resin composition. Furthermore, examples may also include a method for well drilling in which a combination of the materials forming the ball sealer and the ball seat are replaced with each other to perform well treatment.

In a case where the well temperature is low and degradation of the downhole tool or the downhole tool component included in the downhole tool is hard to proceed at a desired rate, for example, a fluid at higher temperature can be supplied around the downhole tool or the downhole tool component. Conversely, in a well environment in which the well temperature is high and the degradation of the downhole tool or the downhole tool component included in the downhole tool starts and proceeds before a lapse of a desired period of time, a treatment method in which the temperature around the downhole tool or the downhole tool component is controlled by injecting a fluid from above ground (cooldown injection) can be employed.

6. Summary

As is clear from the above descriptions, the present invention includes the following.

A downhole tool including: a component containing a reactive metal; and a component containing a degradable resin composition promoting degradation of the reactive metal, the degradable resin composition containing a degradable resin producing an acid by degradation, in which a molar ratio of a maximum amount of the acid which the degradable resin composition is capable of producing to a content of the reactive metal is 1.0 or higher.

In addition, the degradable resin is preferably an aliphatic polyester.

In addition, the aliphatic polyester is preferably at least one selected from the group consisting of polyglycolic acids, polylactic acids, and copolymers of a glycolic acid and a lactic acid.

In addition, the reactive metal is preferably a single substance of base metal element or an alloy containing the base metal element as a main component.

In addition, the reactive metal is preferably a single substance of at least one metal selected from the group consisting of magnesium, aluminum, and calcium; or an alloy containing the metal as a main component.

In addition, the downhole tool is preferably a plug including a slip, and the slip is preferably the component containing the reactive metal.

In addition, a method for well drilling using a downhole tool, in which the downhole tool described above is used.

A method for well drilling using the downhole tool described above, in which the reactive metal is degraded or eliminated by the acid.

Examples will be shown below, and embodiments of the present invention will be described in further detail. The present invention is of course not limited to the examples below, and it goes without saying that various aspects are possible for the details. Furthermore, the present invention is not limited to the embodiments described above, various modifications are possible within the scope indicated in the claims, and embodiments obtained by appropriately combining the technical means each disclosed are also included in the technical scope of the present invention. In addition, all the documents described in the present specification are hereby incorporated by reference.

EXAMPLES

As examples, the following measurements 1 and 2 were performed.

Measurement 1

A magnesium alloy material containing 9 wt. % of aluminum and from 0.2 wt. % to 0.5 wt. % of nickel was melted under argon gas atmosphere and poured into a desired mold. The alloy was then cooled, and a cast billet with an outer diameter of 176 mm was prepared. Here, the alloy material may contain another metal. The cast billet was subjected to homogenization treatment at 400° C.

The material was then extruded into a mold at an extrusion ratio of 10, and a stock shape with an outer diameter of 50 mm and an inner diameter of 20 mm was obtained. The resulting stock shape of the magnesium alloy was cut into cubes. In addition, a PGA solidification extrusion stock shape (φ100 mm, available from Kureha Corporation, hereinafter the PGA) as a polyglycolic acid was cut into rectangular parallelepiped shape to give a weight ratio of 4.6 (a molar ratio of 1.95) to the magnesium alloy.

For the molar ratio, the molecular weights of the PGA and the magnesium alloy were calculated as follows. The molecular weight of the PGA was calculated with the repeating unit (—$CH_2$—COO—) as 58. In addition, the magnesium alloy contained 91% of Mg (molecular weight 24.305) and 9% of Al (molecular weight 26.98), and thus the molecular weight was calculated by 24.305×0.91+26.98×0.09 as 24.546.

Then, a degradation test of the magnesium alloy was performed. First, each one of the cubes of the magnesium alloy obtained by cutting into cubes with each edge of 10 mm in length and the rectangular parallelepiped obtained by cutting the PGA were immersed in 1 L of a 0.05% KCl aqueous solution. The temperature was raised to 121° C. in an autoclave and then a holding time was set, and the cubes and the rectangular parallelepiped were removed from the aqueous solution, then dried at room temperature for 1 hour, and the weights were measured. The holding time were 0 hours, 5 hours, and 10 hours.

From the weight loss of the magnesium alloy at the time, a weight loss rate per unit surface area (mg/cm$^2$/day) was calculated. In addition, the average of the resulting weight loss rates was determined. The weight loss rate is an indicator of the degradation rate. The results are shown in Table 1.

Measurement 2

Measurement was performed in the same manner as in Measurement 1 with the exception that the weight ratio of the PGA to the magnesium alloy was 3.6 (a molar ratio of 1.52).

As comparative examples, the following Measurements 3 and 4 were performed.

Measurement 3

Measurement was performed in the same manner as in Measurement 1 with the exception that the weight ratio of the PGA to the magnesium alloy was 2.3 (a molar ratio of 0.97). Furthermore, the weight loss rate when the holding time was 20 hours was calculated.

Measurement 4

Measurement was performed in the same manner as in Measurement 1 with the exception that the weight ratio of the PGA to the magnesium alloy was 1.2 (a molar ratio of 0.51). Furthermore, the weight loss rate when the holding time was 20 hours was calculated.

TABLE 1

| | | PGA/ Mg alloy | | Temperature | Weight loss rate (mg/cm$^2$/day) | | | | |
|---|---|---|---|---|---|---|---|---|---|
| | | Weight ratio | Molar ratio | (° C.) | Holding time 0 | 5 | 10 | 20 | Average |
| Examples | Measurement 1 | 4.60 | 1.95 | 121 | 442 | 420 | 449 | — | 435 |
| | Measurement 2 | 3.60 | 1.52 | 121 | 477 | 336 | 358 | — | 347 |
| Comparative Examples | Measurement 3 | 2.30 | 0.97 | 121 | 388 | 214 | 207 | 144 | 188 |
| | Measurement 4 | 1.20 | 0.51 | 121 | 361 | 190 | 80 | 76 | 115 |

As is clear from Table 1, in Measurements 1 and 2, the weight loss rate was high at the initial stage of the reaction, and sufficient weight loss rate was maintained even after a lapse of time.

On the other hand, in Measurements 3 and 4, the weight loss rate was low, and the rate further decreased as time passed. This is thought to be due to the molar ratio of the PGA to the magnesium alloy of less than 1.0.

In addition, as reference test examples, the following Measurements 5 and 6 were performed.

Measurement 5

Measurement was performed in the same manner as in Measurement 3 with the exception that the temperature in the autoclave was 66° C. The weight loss rate was calculated only when the holding time was 0 hours and 10 hours. The results are shown in Table 2.

Measurement 6

Measurement was performed in the same manner as in Measurement 4 with the exception that the temperature in the autoclave was 66° C. The weight loss rate was calculated only when the holding time was 0 hours and 10 hours. The results are shown in Table 2.

TABLE 2

| | PGA/Mg alloy | | Temperature | Weight loss rate (mg/cm$^2$/day) | | |
|---|---|---|---|---|---|---|
| | Weight ratio | Molar ratio | (° C.) | Holding time 0 | 10 | Average |
| Measurement 5 | 2.30 | 0.97 | 66 | 216 | 193 | 205 |
| Measurement 6 | 1.20 | 0.51 | 66 | 211 | 202 | 207 |

Measurements 5 and 6 were measurements performed under low temperature conditions, but as is clear from Table 2, the weight loss rate did not change even when the ratio of the PGA was increased.

INDUSTRIAL APPLICABILITY

The present invention can be used in well drilling and thus has high industrial applicability.

REFERENCE SIGNS LIST

1 Mandrel
2 Annular rubber component (degradable rubber component)
3*a*, 3*b* Slip
4*a*, 4*b* Wedge
5*a*, 5*b* (Pair of) rings
10 Ball sealer (ball)
11 Ball seat
H Inner wall of downhole
h Hollow part of mandrel

The invention claimed is:

1. A downhole tool comprising:
a first member made of a reactive metal; and
a second member made of a degradable resin composition promoting degradation of the reactive metal,
the degradable resin composition containing a degradable resin producing an acid by degradation,
wherein the molar ratio of the amount of the acid which the degradable resin composition in the second member is capable of producing to the content of the reactive metal in the first member is 1.0 or higher.

2. The downhole tool according to claim 1, wherein the degradable resin is an aliphatic polyester.

3. The downhole tool according to claim 2, wherein the aliphatic polyester is at least one selected from the group consisting of polyglycolic acids, polylactic acids, and copolymers of a glycolic acid and a lactic acid.

4. The downhole tool according to claim 1, wherein the reactive metal is a single substance of a base metal element or an alloy containing the base metal element as a main component.

5. The downhole tool according to claim 1, wherein the reactive metal is a single substance of at least one metal selected from the group consisting of magnesium, aluminum, and calcium; or an alloy containing the metal as a main component.

6. The downhole tool according to claim 1, wherein
the downhole tool is a plug comprising a slip of the first member.

7. A method for well drilling using a downhole tool, wherein the downhole tool described in claim 1 is used as the downhole tool.

8. The downhole tool according to claim 1, wherein the molar ratio of the amount of the acid which the degradable resin composition in the second member is capable of producing to the content of the reactive metal in the first member is 1.5 or higher.

9. The downhole tool according to claim 1, wherein the molar ratio of the amount of the acid which the degradable resin composition in the second member is capable of producing to the content of the reactive metal in the first member is 1.8 or higher.

10. The downhole tool according to claim 1, wherein a weight loss rate of the reactive metal in 1 L of a 0.05% KCl aqueous solution at 121° C. is 347 to 435 $mg/cm^2/day$, and the weight loss rate of the reactive metal is calculated by average of weight loss rate at a holding time from 0 to 10 hours.

* * * * *